US008602503B2

(12) United States Patent
Dubay et al.

(10) Patent No.: US 8,602,503 B2
(45) Date of Patent: Dec. 10, 2013

(54) CUTTER ASSEMBLY CONFIGURED TO ALLOW TOOL ROTATION

(75) Inventors: Gregory Henry Dubay, Zimmerman, MN (US); Kevin W. Ingall, Maple Grove, MN (US); Randall Steven Kessler, Otsego, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 460 days.

(21) Appl. No.: 12/828,194

(22) Filed: Jun. 30, 2010

(65) Prior Publication Data

US 2012/0001475 A1 Jan. 5, 2012

(51) Int. Cl.
*E21C 35/18* (2006.01)
*E21C 35/19* (2006.01)

(52) U.S. Cl.
USPC ..... 299/108; 299/102; 299/103; 299/104; 299/106; 299/110

(58) Field of Classification Search
USPC ..... 299/102, 103, 104, 106, 107, 108, 110
See application file for complete search history.

(56) References Cited

U.S. PATENT DOCUMENTS

| | | | | |
|---|---|---|---|---|
| 2,743,917 | A * | 5/1956 | Krekeler et al. | 299/103 |
| 2,965,365 | A * | 12/1960 | Krekeler | 299/109 |
| 3,268,260 | A | 8/1966 | Snipe | |
| 3,342,531 | A | 9/1967 | Krekeler | |
| 3,622,206 | A * | 11/1971 | Krekeler | 299/109 |
| 3,690,728 | A * | 9/1972 | Krekeler | 299/109 |
| 4,595,241 | A * | 6/1986 | Gilbert et al. | 299/108 |
| 5,374,111 | A | 12/1994 | Den Besten et al. | |
| 6,086,160 | A | 7/2000 | Bitelli | |
| 6,176,552 | B1 | 1/2001 | Topka, Jr. et al. | |
| 6,244,665 | B1 | 6/2001 | Bise et al. | |
| 6,331,035 | B1 | 12/2001 | Montgomery, Jr. | |
| 6,786,557 | B2 | 9/2004 | Montgomery, Jr. | |
| 6,962,395 | B2 | 11/2005 | Mouthaan | |
| 7,520,570 | B2 | 4/2009 | Sansone et al. | |
| 2004/0004389 | A1 | 1/2004 | Latham | |

FOREIGN PATENT DOCUMENTS

| | | |
|---|---|---|
| GB | 729796 A | 5/1955 |
| GB | 2068435 A | 8/1981 |

* cited by examiner

*Primary Examiner* — Sunil Singh
*Assistant Examiner* — Carib Oquendo
(74) *Attorney, Agent, or Firm* — Finnegan, Henderson, Farabow, Garrett & Dunner LLP

(57) ABSTRACT

A base block for a cutting drum is disclosed. The base block may have a first end. The first end may have an opening configured to receive a tool. The first end may also have a flat surface surrounding the opening. The base block may have a second end configured to abut the cutting drum. The base block may further have an internal passageway commencing at the opening configured to receive the tool. The passageway may define a longitudinal axis that is offset by an acute angle from being perpendicular to the flat surface.

7 Claims, 8 Drawing Sheets

CUTTER ASSEMBLY CONFIGURED TO ALLOW TOOL ROTATION

TECHNICAL FIELD

The present disclosure relates generally to a cutter assembly and, more particularly, to a cutter assembly configured to allow tool rotation.

BACKGROUND

Rotary material cutting and milling devices, such as, for example, road pavement mills, surface mining machines, and rotary cutter attachments for hydraulic excavators, utilize replaceable cutting tools or bits to cut and remove material from a surface. Typically, the cutting tools wear out quickly. For example, in heaving cutting and milling operations, the cutting tools may need to be replaced on a daily basis. In some cutting or milling devices, the cutting tool is removably mounted to a tool holder that is itself removably mounted to a rotary drum. In such devices, the tool holder may also wear out and require replacement.

Many cutting tools include features that facilitate removal of the cutting tool. One such feature is disclosed in U.S. Pat. No. 7,520,570 to Sansone et al. ("the '570 patent"). The '570 patent discloses a cutting tool holder mounted to a rotary member of a rotary cutting device. The tool holder may include a tapered body that may be removably received in a tapered tool holder socket. The tool holder may also include first and second extraction grooves. By applying force to extraction wedges, the wedges may be driven into the first and second grooves, thus causing the tool holder to move out of a tool holder socket.

Although the device of the '570 patent may facilitate removal of the tool holder, it may still be improved further. Specifically, although the tool holder of the '570 patent may be more easily removed, the usable life of the tool holder may still be limited. This disclosure is directed at overcoming one or more of the problems described above.

SUMMARY

In one aspect, the present disclosure is directed to a base block for a cutting drum. The base block may include a first end. The first end may include an opening configured to receive a tool. The first end may also include a flat surface surrounding the opening. The base block may include a second end configured to abut the cutting drum. The base block may further include an internal passageway commencing at the opening configured to receive the tool. The passageway may define a longitudinal axis that is offset by an acute angle from being perpendicular to the flat surface.

In another aspect, the present disclosure is directed to a method of replacing a tool located in a base block of a cutting drum. The method may include inserting a removal device in a space between the base block and the tool. The space may be located between an upper surface of the base block and a lower surface of the tool. The lower surface of the tool and the upper surface of the base block may form an acute angle. The method may further include at least partially removing the tool from the base block by applying a force to the removal device. The method may also include rotating the tool about its longitudinal axis by an angle. The method may further include replacing the tool in the base block at the rotated angle.

In yet another aspect, the present disclosure is directed to a cutter assembly. The cutter assembly may include a base block having a flat upper surface and an opening located in the upper surface. The surface may be flat about the opening. The cutter assembly may also include a tool including a shaft configured to be received in the base block and a flange adjacent the shaft. The flange may have a flat lower surface. The shaft of the tool may be located in the opening of the base block such that a portion of the flat lower surface is adjacent to the upper surface of the base block. The flat lower surface of the flange and the flat upper surface of the base block may form an acute angle.

DETAILED DESCRIPTION

Figure 1:
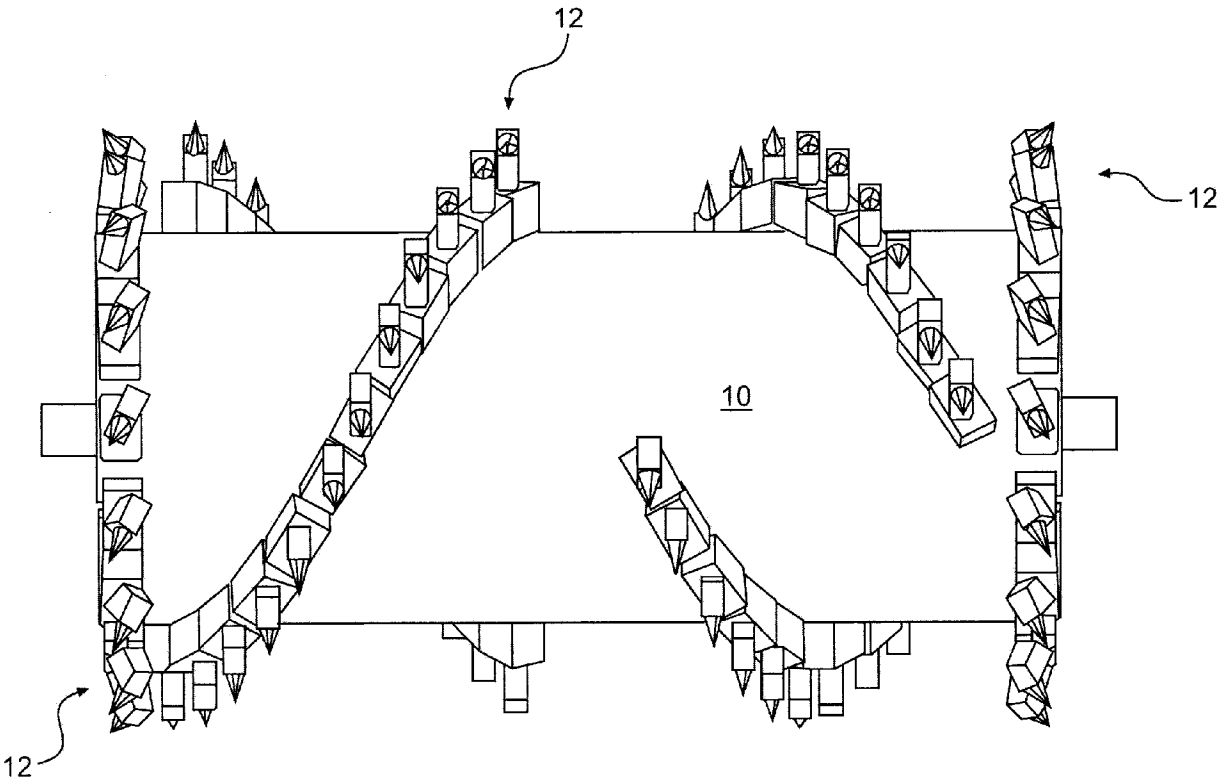
FIG. 1 is a diagrammatic illustration of an exemplary disclosed cutting drum.

FIG. 1 illustrates an exemplary rotary cutting device, such as a cutting drum or rotor 10. Cutting drum 10 may be rotatably connected to, for example, a road pavement mill, a surface mining machine, or any other suitable machine known in the art (not shown). Cutting drum 10 may include a plurality of cutter assemblies 12. Cutter assemblies 12 may be arranged on cutting drum 10 in any appropriate pattern, such as a helical and/or an annular pattern.

Figure 2:
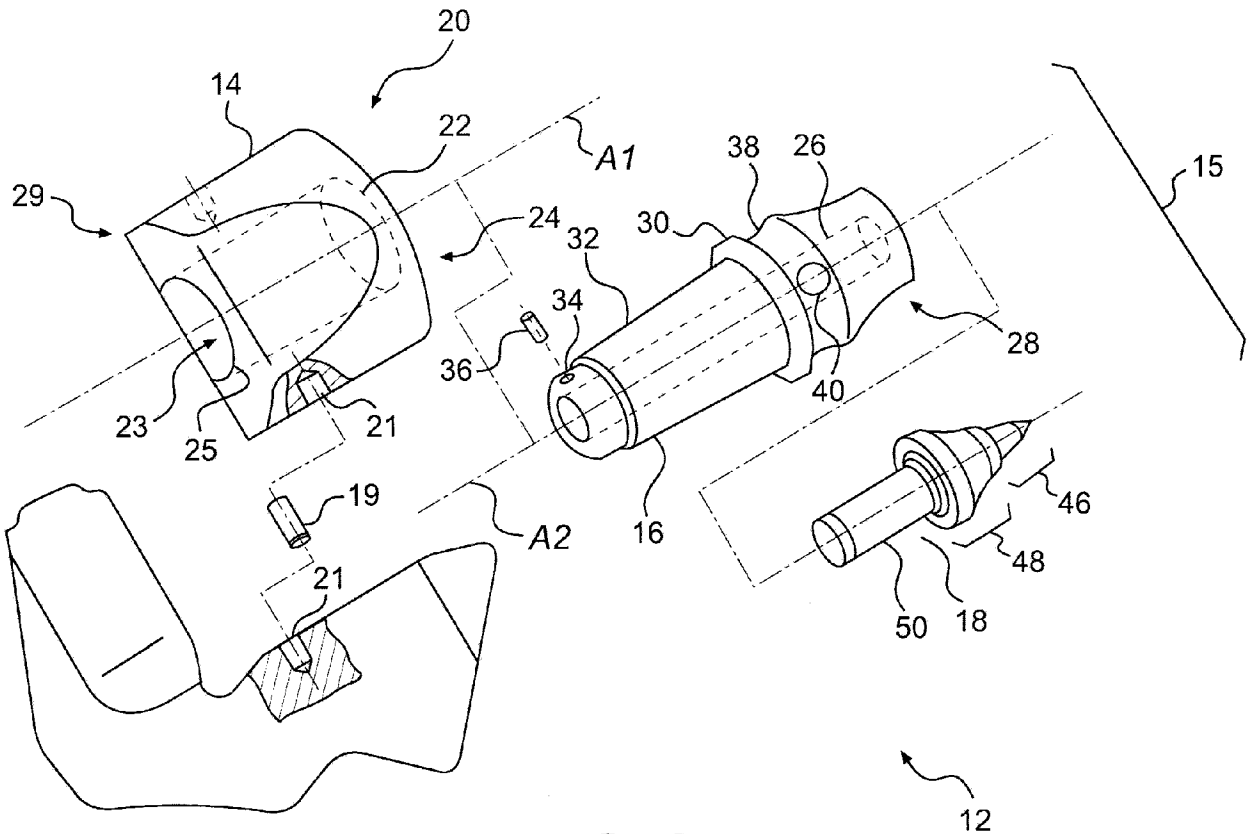
FIG. 2 is an exploded view of an exemplary cutter assembly.

FIG. 2 illustrates in more detail an exemplary cutter assembly 12. Each cutter assembly 12 may include a base block 14 and a tool 15. Each tool 15 may include a tool holder 16 and a cutting tool 18.

Base block 14 may be a rigid structure connected to cutting drum 10 and configured to secure tool 15. It is contemplated that base block 14 may be formed integrally with cutting drum 10. Alternatively, base block 14 may abut and be fixedly coupled to cutting drum 10 via welding, mechanical fasteners, and/or any other appropriate fastening method known in the art. In embodiments where base block 14 is welded to cutting drum 10, one or more dowels 19 may be located in alignment holes 21 in order to aid in alignment of base block 14. Base block 14 may be composed of metal or any other appropriate material. For example, base block 14 may be composed of hardened steel or tungsten carbide.

Figure 3:
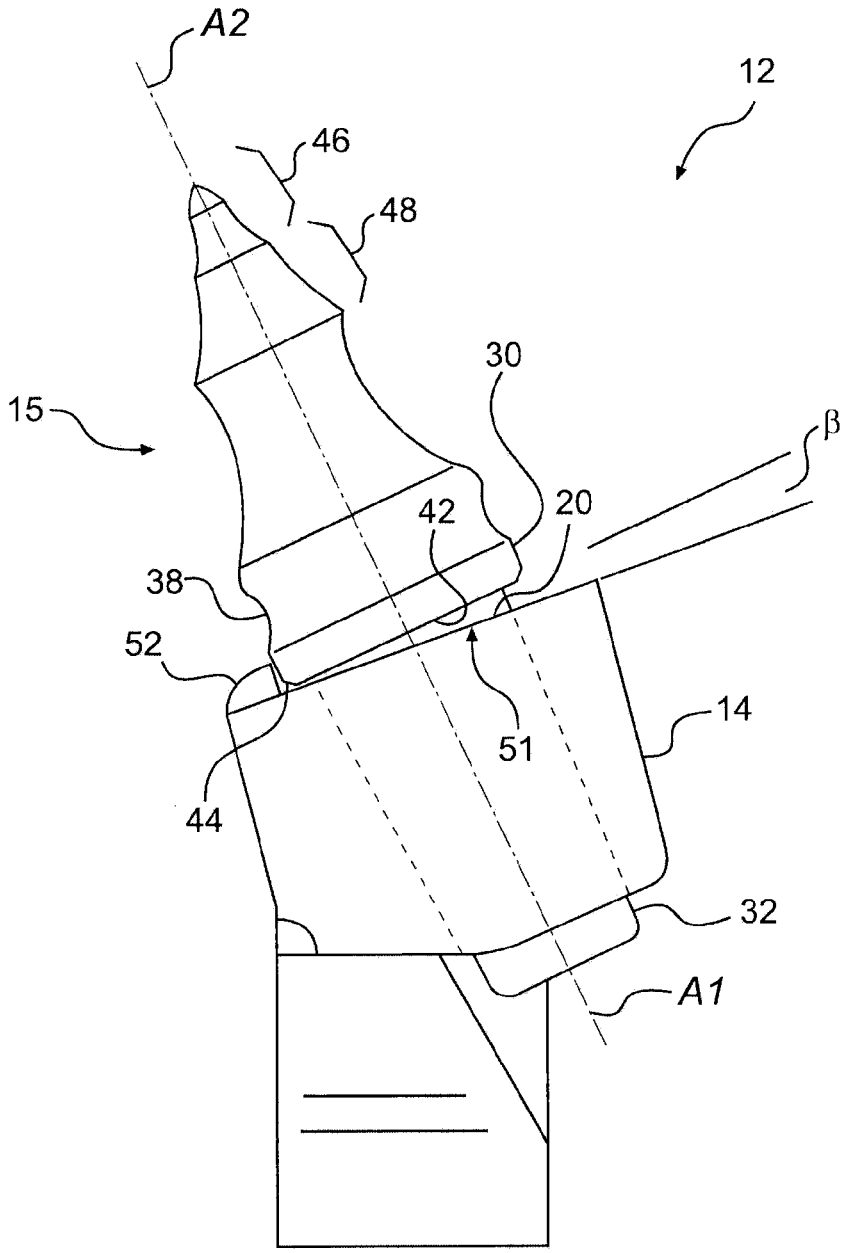
FIG. 3 is a diagrammatic illustration of another embodiment of the disclosed cutter assembly.

Base block 14 may include an upper surface 20 on a first end 24 of base block 14 (see also FIG. 3). It is contemplated that upper surface 20 may be flat. Base block 14 may define an opening 22 in upper surface 20. Opening 22 may be configured to receive tool 15. It is contemplated that opening 22 may be substantially circular. Base block 14 may define a passageway 23 commencing at opening 22. Passageway 23 may be configured to slidably receive tool 15. It is contemplated that passageway 23 may taper along a length of base block 14. Passageway 23 may alternatively have a cylindrical shape or any other appropriate shape known in the art.

Opening 22 and passageway 23 may define an axis A1. Axis A1 may be offset from being perpendicular to upper surface 20 by an angle β (see FIG. 3). It is contemplated that β may be in the range of about 4-25 degrees, and more particularly about 5-10 degrees. In one embodiment, β may be 7 degrees. Base block 14 may also define an opening 25 on a second end 29 of base block 14. Opening 25 may be configured to allow at least a portion of tool 15 to protrude from second end 29 of base block 14 (see FIG. 3).

Tool holder 16 may be a sleeve-like structure configured to hold cutting tool 18. Specifically, tool holder 16 may secure a shank 50 of cutting tool 18 such that cutting tool 18 may be applied to a cut a surface. It is contemplated that tool holder 16 may be composed of any appropriate material, such as, for example, hardened steel, tungsten carbide, diamond, or any combination thereof. Tool holder 16 may have a substantially cylindrical, rectangular, or any other appropriate shape. Tool holder 16 may include an internal passageway 26. Tool holder 16 may also include a tool receiving end 28. Tool receiving end 28 may be configured to receive cutting tool 18. It is contemplated that tool receiving end 28 may have the general shape of a truncated cone, and an outer surface of tool receiving end 28 may be slightly concave or may be flat.

Tool holder 16 may also have a flange 30 and a shaft 32. Shaft 32 may be tapered and configured to be slidably received by opening 22 and passageway 23 of base block 14. Specifically, shaft 32 may have the shape of a truncated cone. It is contemplated that shaft 32 may be secured in base block 14 via an interference fit. Shaft 32 may additionally or alternatively include a hole 34 near a terminal portion of shaft 32. Hole 34 may be configured to receive a pin member 36 to secure tool holder 16 in base block 14.

Tool holder 16 may include an annular recess 38. An access hole 40 may be located in or near annular recess 38. Access hole 40 may be configured to allow a cutting tool extractor (not shown) to access and release cutting tool 18. A location of access hole 40 may additionally or alternatively provide a desired point of weakness at which tool holder 16 may fail in excessive load situations.

Cutting tool 18 may be any tool configured to cut. Cutting tool 18 may include a tip 46, a central portion 48, and shank 50. Tip 46 may have general conical shape. Tip 46 may be composed of diamond, tungsten carbide, or any other appropriate material. Tip 46 may be secured to central portion 48. Central portion 48 may be composed of hardened steel, tungsten carbide, or any other appropriate material. Shank 50 may be configured to be received and secured by tool holder 16. Shank 50 may be secured by an interference fit or by a securing mechanism, such as a spring, a dowel, or any other securing mechanism known in the art.

Referring to the embodiment of cutter assembly 12 shown in FIG. 3, tool 15 may include cutting tool 18 and tool holder 16 as a single non-separable and/or integral component. In all other respects, this embodiment may be similar to other embodiments disclosed herein.

As can be seen in FIG. 3, when tool 15 is located in base block 14, at least a portion of lower surface 42 of flange 30 may be adjacent to base block 14. It is contemplated that tool 15 may define a longitudinal axis A2. Upon insertion of tool 15, and specifically shaft 32, in opening 22 of base block 14, axis A1 and axis A2 may align such that the axes are parallel and/or coincident. Shaft 32 may pass into opening 22 until a portion of lower surface 42 of tool 15 is slightly above upper surface 20 of base block 14. In other words, when tool 15 is secured within base block 14, lower surface 42 may remain above base block 14 such that at least some vertical space remains between upper surface 20 and lower surface 42 at all locations on lower surface 42. The vertical space may be at least 1 mm. In an alternative configuration, shaft 32 may pass into opening 22 until a portion of lower surface 42 of tool 15 abuts upper surface 20 of base block 14.

Lower surface 42 of tool 15 may be substantially flat and define a plane that is substantially perpendicular to axis A2. It is contemplated that an outer edge of flange 30 may have a chamfer 44 to distribute load due to any contact between flange 30 and upper surface 20. When tool 15 is received within base block 14, lower surface 42 of tool 15 and upper surface 20 of base block 14 may form a space 51. Space 51 may be substantially wedge shaped (e.g., wedge may be defined by angle β). It is contemplated that a space 51 may exist on each lateral side of tool 15.

Figure 4:
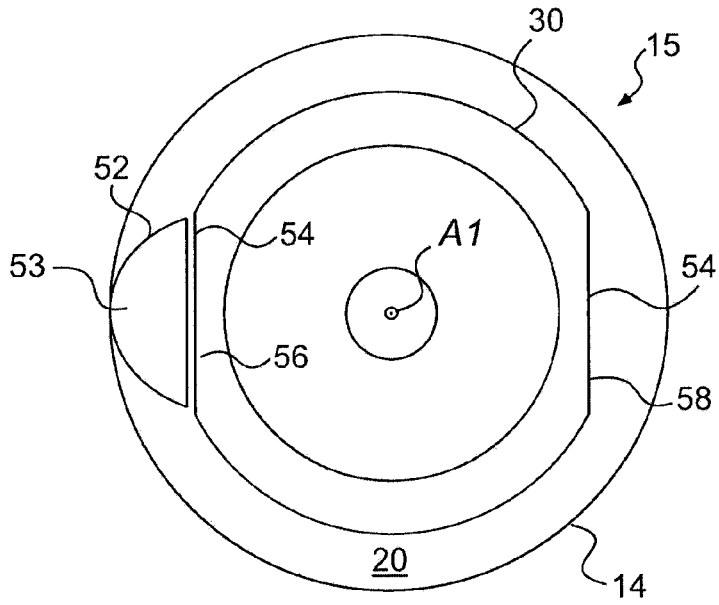
FIG. 4 is a top view of the disclosed cutter assembly of FIG. 3.

As shown in FIG. 4, base block 14 may include one or more keys 52 to allow alignment of tool 15 within base block 14. Key 52 may constrain rotation of tool 15 about axis A1. Key 52 may be integrally formed with base block 14 or may be attached to base block 14 via welding, mechanical fasteners, or any other appropriate method. Key 52 may have at least one surface configured to abut a surface feature 54 of tool 15. A back and/or top surface 53 of key 52 may be rounded to prevent key 52 from catching on objects as tool 15 and base block 14 cut through material.

Key 52 may be located on upper surface 20 of base block 14. It is contemplated that key 52 may alternatively or additionally be located in passageway 23 or in any other appropriate location on base block 14. When key 52 is located on upper surface 20, surface feature 54 may be located on an outer periphery of flange 30. When key 52 is located in passageway 23, surface feature 54 may be located on shaft 32.

Figure 5:
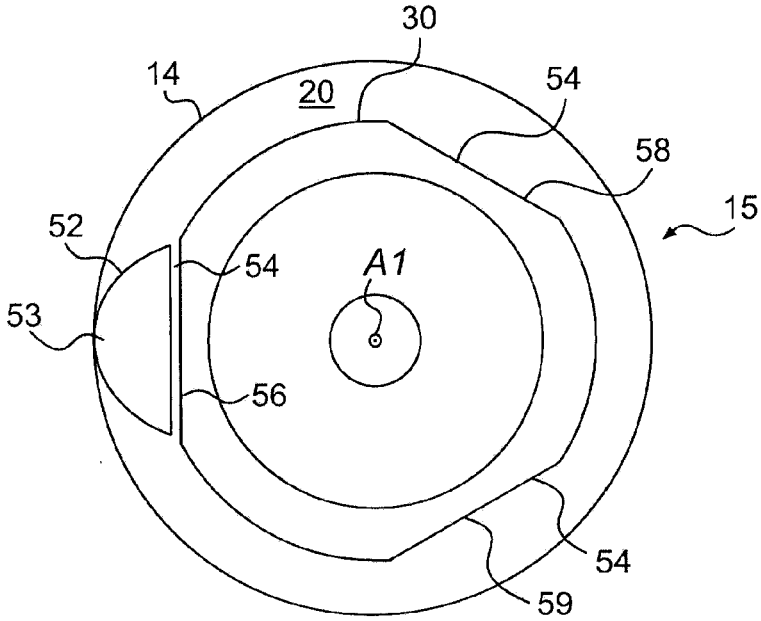
FIG. 5 is a diagrammatic illustration of another embodiment of the cutter assembly of FIG. 4.

Tool 15 may include a plurality of surface features 54 to allow tool 15 to be positioned in several different orientations. For example, as shown in FIG. 4, tool 15 may include a first surface feature 56 and a second surface feature 58 offset at 180 degrees from first surface feature 56. As shown in FIG. 5, tool 15 may also include a first surface feature 56, a second surface feature 58, and a third surface feature 59 offset at 120 degrees from each other. It is contemplated that tool 15 may have additional surface features 54.

Figure 6:
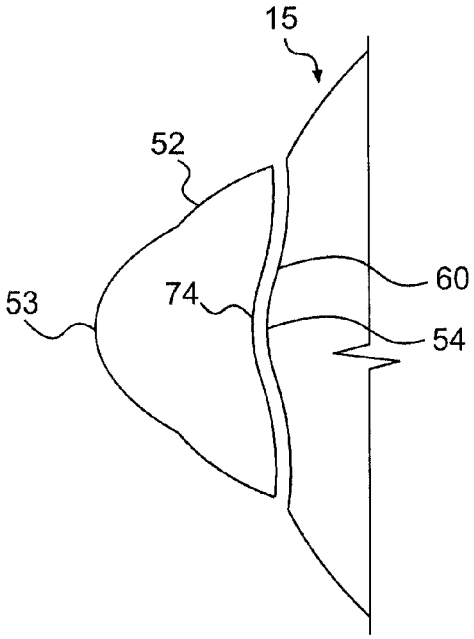
FIG. 6 is a diagrammatic illustration of a key used in a cutter assembly.
Figure 7:
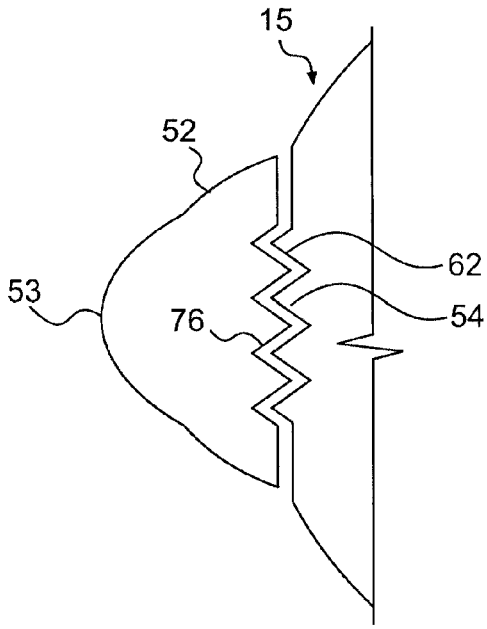
FIG. 7 is a diagrammatic illustration of an alternative embodiment of the key of FIG. 6.
Figure 8:
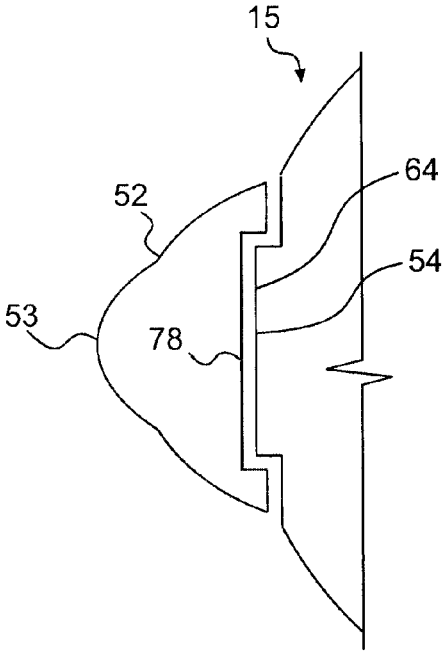
FIG. 8 is a diagrammatic illustration of another alternative embodiment of the key of FIG. 6.
Figure 9:
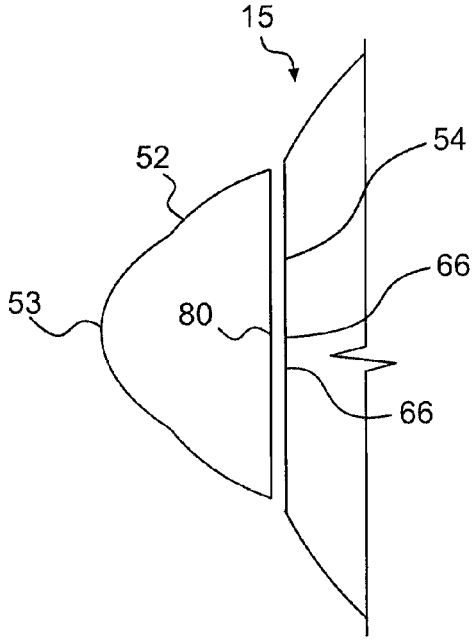
FIG. 9 is a diagrammatic illustration of another alternative embodiment of the key of FIG. 6.

As shown in FIGS. 6-9, surface features 54 may comprise several different geometries. As shown in FIG. 6, surface feature 54 may comprise a curved surface 60. Curved surface 60 may have a single curved protrusion or may have a plurality of curved protrusions. As shown in FIG. 7, surface feature 54 may comprise a jagged or sawtooth surface 62. As shown in FIG. 8, surface feature 54 may comprise a rectangular protrusion 64. As shown in FIG. 9, surface feature 54 may comprise a flat surface 66.

It is contemplated that each of surfaces 60, 62, 64, and 66 may mate with a corresponding surface on key 52. Specifically, as shown in FIG. 6, key 52 may include a curved recess 74. As shown in FIG. 7, key 52 may include a jagged or sawtooth surface 76. As shown in FIG. 8, key 52 may include a rectangular recess 78. Also, as shown in FIG. 9, key 52 may include a flat surface 80.

Figure 10:
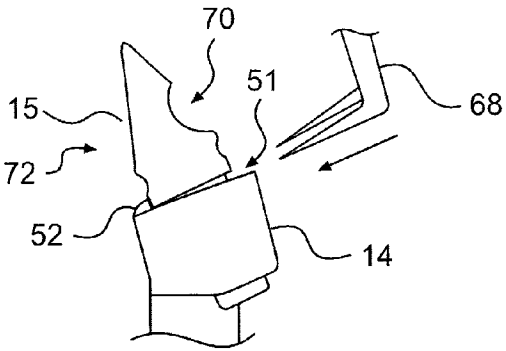
FIG. 10 is a diagrammatic illustration of insertion of a tool into a cutter assembly.

FIG. 10 illustrates a tool 15 that has been worn unevenly during use. This uneven wear may occur, in part, because some surfaces of tool 15 are exposed to harsher wear conditions than other surfaces of tool 15. Varying conditions may wear a first surface 70 of tool 15 to a point where first surface 70 is substantially spent, while a second surface 72 of tool 15 still has useful life. It is also contemplated that wear on tool 15 may be uneven between tip 46 and central portion 48 due to the different materials used in the construction thereof.

FIGS. 10-13 illustrate a method of removing and rotating tool 15 located in base block 14. To remove tool 15, a removal tool 68 may be inserted in space 51. Removal tool 68 may include a fork with two wedge-shaped protrusions. Removal tool 68 may also include a lever connected to the fork.

Figure 11:
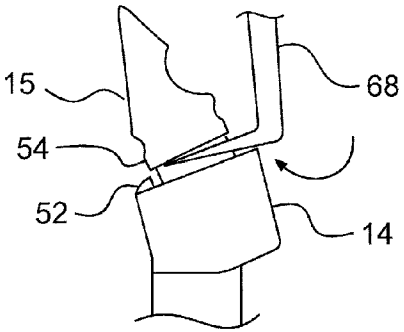
FIG. 11 is a diagrammatic illustration of removal of a tool from a cutter assembly.

As shown in FIG. 11, removal tool 68 may pivot in order to pry tool 15 free of base block 14. In other words, a force may be applied to removal tool 68 that is transmitted to tool 15 and base block 14 causing tool 15 to axially displace from base block 14. It is contemplated that removal tool 68 may either be applied to cutter assembly 12 manually by a user or applied automatically by a machine.

Figure 13:
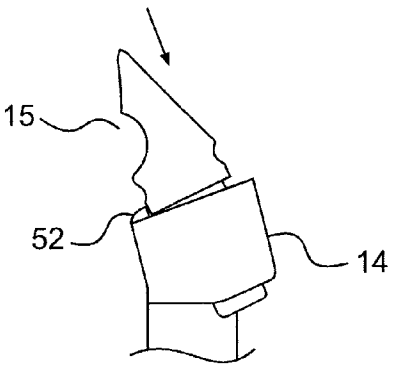
FIG. 13 is a diagrammatic illustration of replacement of a tool in a cutter assembly.
Figure 12:
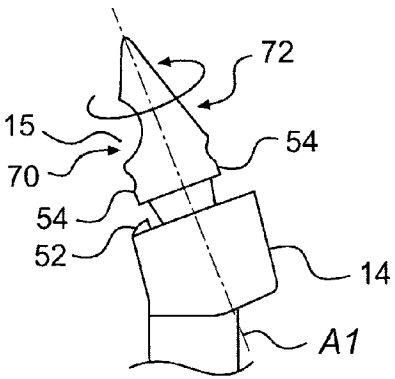
FIG. 12 is a diagrammatic illustration of rotation of a tool in a cutter assembly.

As shown in FIG. 12, after tool 15 has been at least partially removed from base block 14, tool 15 may be rotated about axis A1. Specifically, tool 15 may be rotated 180 degrees about axis A1. As shown in FIG. 13, after rotation, tool 15 may be slidably replaced and secured in base block 14. Upon replacement, key 52 may reengage surface feature 54, thus securing tool 15 within base block 14.

Rotating tool 15 about axis A1 and replacing tool 15 may expose a different surface, such as second surface 72, to the harsher wear conditions. It is contemplated that tool 15 may be rotated different amounts depending on wear conditions and the configuration of tool 15. For example, as shown in FIG. 5, embodiments that include three surface features 54 may allow for tool 15 to be removed, rotated by 120 degrees, and replaced, thus extending the useful life of tool 15. The process of removal, rotation, and replacement of a given tool 15 may be repeated as necessary by an operator of cutting drum 10 until tool 15 requires replacement.

Figure 15:
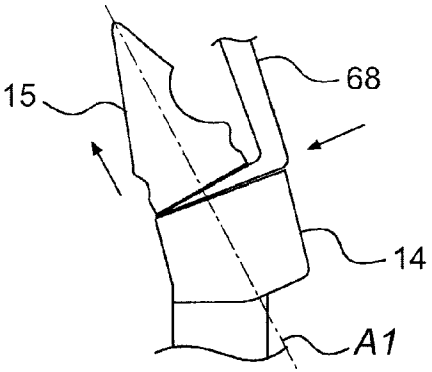
FIG. 15 is a diagrammatic illustration of another method of removal of a tool from a cutter assembly.
Figure 17:
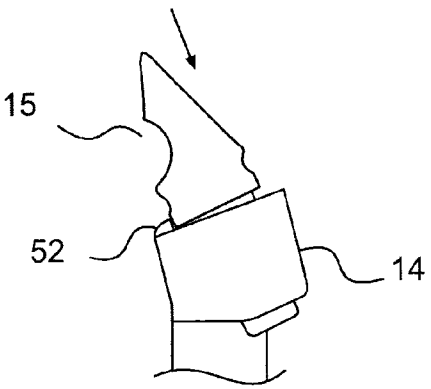
FIG. 17 is a diagrammatic illustration of replacement of a tool in a cutter assembly.
Figure 14:
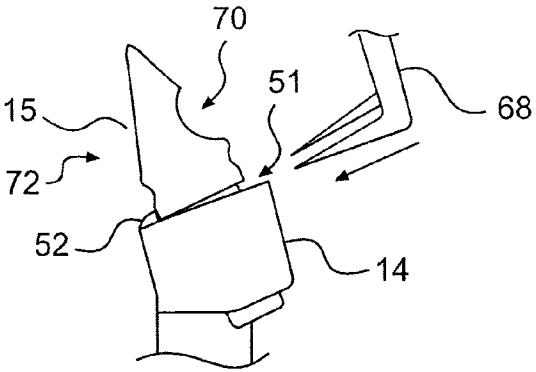
FIG. 14 is a diagrammatic illustration of another method of insertion of a tool into a cutter assembly.
Figure 16:
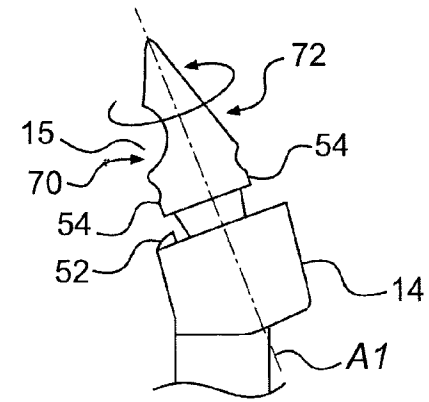
FIG. 16 is a diagrammatic illustration of rotation of a tool in a cutter assembly.
Figure 18:
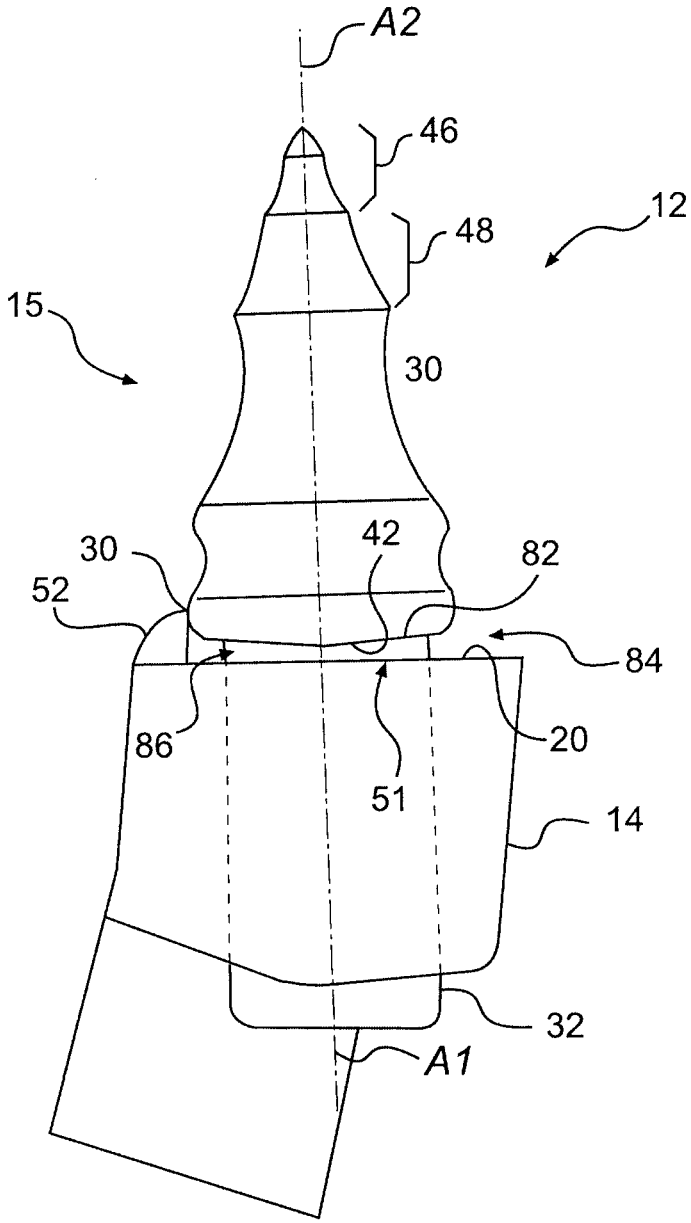
FIG. 18 is a diagrammatic illustration of an alternative embodiment of a tool for a cutter assembly.

FIGS. 14-17 illustrate an alternative method of removing and rotating tool 15 located in base block 14. As shown in FIGS. 14 and 15, removal tool 68 may be inserted into space 51 and advanced in a direction transverse to axis A1 in order to force tool 15 free of base block 14. As shown in FIG. 17, after tool 15 has been removed, tool 15 may be rotated about axis A1. FIG. 18 shows tool 15 being slidably replaced and secured in base block 14. Upon replacement, key 52 may reengage surface feature 54, thus securing tool 15 within base block 14. It is further contemplated that additional or alternative removal tools 68 and removal methods may used.

FIG. 18 illustrates another alternative embodiment of tool 15. In this embodiment upper surface 20 of base block 14 may be substantially perpendicular to Axis A2. Additionally, in the embodiment of FIG. 18, a lower surface 82 of flange 30 may be substantially v-shaped. It is contemplated that a v-shaped surface 82 may be located on each lateral side of tool 15 (only one side shown in FIG. 18).

A first side 84 of v-shaped surface 82 may allow insertion of a wedge-shaped removal tool 68 in a direction transverse to axis A1 in order to force tool 15 free of base block 14. If tool 15 is rotated by 180 degrees about axis A2, a second side 86 of v-shaped surface 82 may also allow insertion of wedge-shaped removal tool 68 for removal of tool 15 from base block 14. Therefore, v-shaped surface 82 may allow removal and rotation of tool 15 located in base block 14.

INDUSTRIAL APPLICABILITY

The disclosed cutter assembly may be applicable to any cutting device. The disclosed cutter assembly may also allow for the tool to be configured at several different angular orientations within the base block. The disclosed cutter assembly may also provide for easy removal of the tool. It is contemplated that the disclosed cutter assembly, and specifically the configuration of the base block and the tool, may allow for rotation and reuse of a given tool, and thus provide improved usable life. Productivity may also be increased since removing and rotating an existing tool may be accomplished more quickly than removing an existing tool and replacing it with a new tool.

It will be apparent to those skilled in the art that various modifications and variations can be made to the disclosed cutter assembly. Other embodiments will be apparent to those skilled in the art from consideration of the specification and practice of the disclosed cutter assembly. It is intended that the specification and examples be considered as exemplary only, with a true scope being indicated by the following claims.

What is claimed is:

1. A base block for a cutting drum, comprising:

a first end including:

an opening configured to receive a tool having a flange with a flat lower surface, wherein the flat lower surface of the flange is perpendicular to a longitudinal axis of the tool;

a flat surface surrounding the opening, wherein the flange is configured to be located at least partially above the flat surface during operation;

a second end configured to abut the cutting drum;

an internal passageway commencing at the opening configured to receive the tool, the internal passageway defining a longitudinal axis, the axis being offset by an acute angle from being perpendicular to the flat surface; and a key located on the flat surface, wherein the key has at least one surface configured to abut a surface of the tool to prevent the tool from rotating about the tool longitudinal axis, wherein the at least one surface of the key has one or more recessed surfaces configured to mate with one or more protrusions of the tool.

2. The base block of claim 1, wherein the internal passageway tapers along a length of the passageway.

3. The base block of claim 1, further including: a dowel hole, the dowel hole being configured to receive a dowel to secure the base block to the cutting drum; and a second opening located on the second end, the second opening configured to allow at least a portion of the tool to protrude from the second end.

4. The base block of claim 1, wherein the acute angle is between 4 and 25 degrees.

5. The base block of claim 4, wherein the acute angle is further between 5 and 10 degrees.

6. The base block of claim 1, wherein the second end is configured to abut the cutting drum at a second end flat surface, the second end flat surface being not parallel to the flat surface surrounding the opening.

7. The base block of claim 1, wherein the flat lower surface of the flange and the flat surface surrounding the opening are configured to form an acute angle.

* * * * *